US010994562B2

(12) United States Patent
Castells De Monet et al.

(10) Patent No.: US 10,994,562 B2
(45) Date of Patent: May 4, 2021

(54) PRINT-HEAD CARRIAGES

(71) Applicant: HEWLETT-PACKARD DEVELOPMENT COMPANY, L.P., Spring, TX (US)

(72) Inventors: Raimon Castells De Monet, Sant Cugat del Valles (ES); Antoni Sender Beleta, Sant Cugat del Valles (ES); Jose Antonio Alvarez Tapia, Sant Cugat del Valles (ES); Jonatan de la Rubia, Sant Cugat del Valles (ES); Diego Lopez Ubieto, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/467,909

(22) PCT Filed: Apr. 25, 2017

(86) PCT No.: PCT/US2017/029391
§ 371 (c)(1),
(2) Date: Jun. 7, 2019

(87) PCT Pub. No.: WO2018/199931
PCT Pub. Date: Nov. 1, 2018

(65) Prior Publication Data

US 2020/0062014 A1 Feb. 27, 2020

(51) Int. Cl.
*B41J 25/34* (2006.01)

(52) U.S. Cl.
CPC ..... *B41J 25/34* (2013.01)

(58) Field of Classification Search
CPC ..... B41J 2/1752; B41J 25/34; B41J 2/17526; B41J 2/17523
See application file for complete search history.

(56) References Cited

U.S. PATENT DOCUMENTS 6,196,665 B1 3/2001 Weeks
6,293,649 B1 9/2001 Norton
(Continued)

FOREIGN PATENT DOCUMENTS

EP 1018436 B1 2/2003
WO WO-2015185160 A1 12/2015

OTHER PUBLICATIONS

"HP Officejet Pro 8600 Printers 'Carriage Jam' Message Displays"; printed from the internet on Jan. 10, 2017; http://support.hp.com/us-en/product/HP-Officejet-Pro-8600-e-All-in-One-Printer-series---N9/4322915/document/.

*Primary Examiner* — Jannelle M Lebron
(74) *Attorney, Agent, or Firm* — HP Inc. Patent Department

(57) ABSTRACT

It is disclosed a print-head carriage comprising base and a tab with a rotatable connection to the base on a first end, the rotation of the tab defining a closed position in which a second end opposite to the first end is in contact with the base and an open position in which the second end is separated from the base, the base being adapted to receive a print-head along an insertion direction when the tab is in the open position wherein the tab further comprises a latch located at a position remote to the rotatable connection comprising a lever, that separates from the tab in an unlocked position and moves towards the tab in a locked position; wherein the latch comprises a biasing mechanism to bias the latch to the locked position.

20 Claims, 3 Drawing Sheets

(56) References Cited

U.S. PATENT DOCUMENTS

| | | | | |
|---|---|---|---|---|
| 6,367,918 | B1 | 4/2002 | Heiles et al. | |
| 6,481,829 | B1 | 11/2002 | Bailey et al. | |
| 7,717,549 | B2 | 5/2010 | Rademakers et al. | |
| 2012/0268535 | A1* | 10/2012 | Gomez | B41J 2/1752 347/86 |

* cited by examiner

PRINT-HEAD CARRIAGES

BACKGROUND

In wide format printers, a set of the print-heads are located in a carriage, inside a pen pocket base. In order to make the position of the print-head unique, accurate and repeatable, the print-head should be mechanically and electrically connected to reference surfaces such as datum surfaces. Normally such datum surfaces are located at the bottom of the carriage, therefore, a mechanism should be provided to ensure such mechanic and electric connections.

DETAILED DESCRIPTION

A print-head carriage is one of the most important elements of printers and, in particular, wide-format printers given that unwanted movements of the print-head during working conditions, may result in connectivity failures between the print-head and the electrical board that may cause a printing process to be interrupted or even print unwanted noise. Furthermore, users require that the insertion/extraction of print-heads is performed under ergonomic conditions, therefore a need exists for print-head carriages for wide-format printers wherein the carriages provide for an ergonomic insert of the print-heads and yet guarantee a good attachment of the print-heads to the relevant surfaces of the carriage.

Figure 1:
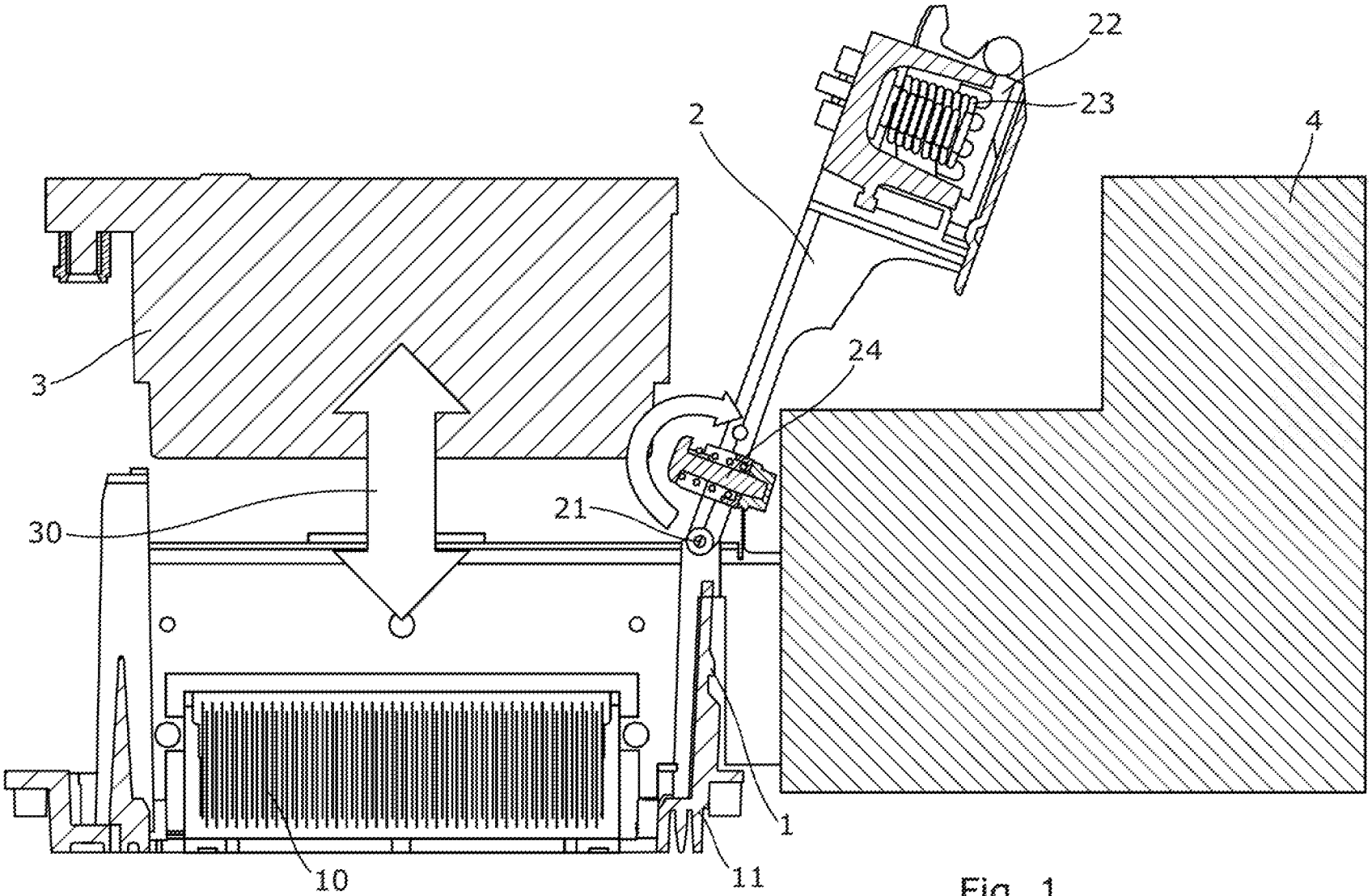
FIG. 1 shows a longitudinal section of part of a printer showing a print-head carriage in an open position.

FIG. 1 shows an example of carriage that allows a greater angle when opening the latch while implementing various push elements to ensure a proper connection to electrical and mechanical contacts of the printer. The carriage comprises a base and a latch 2 being the latch rotatably attached to a first end of the base by means of a rotatable connection 21. The tab 2, through the rotatable connection 21, defines an open position wherein the tab 2 is at a maximum angle $\Phi_A$, for example over 180° and a closed position wherein the tab is at an angle smaller than the maximum angle, for example, around 90°. In other words, when both ends of the tab 2 are in contact with the base 1, the tab 2 is considered to be in the closed position whereas if at least one of the ends is not in contact the base 1, i.e., at least one of the ends is separated from the base 1, the tab 2 is considered to be in an open position.

The tab 2 of FIG. 1 comprises a latch 22 to lock the tab 2 to the base 1 when the base 1 is in the closed position. The latch 22 may also be configured to have two positions, a locked position wherein the latch 22 is attached to a counterpart located on the base of the carriage and an unlocked position in which the latch 22 is not attached to the base, thereby allowing for rotation of the tab 2, i.e., the movement of the tab 2 from the closed position to the open position and vice versa.

To achieve, the locking and unlocking of the latch 22, it comprises a lever that has an extended position, wherein the lever extends radially from the tab and a retracted position wherein, the lever is retracted to the tab thereby occupying less space. The positions of the lever define the locked or unlocked positions of the latch, e.g., when the lever is in a retracted position, i.e., moved towards the tab, the latch is in the locked position whereas is the tab is in an extended position, i.e., separated from the tab, the latch is in the unlocked position.

The latch also comprises a push mechanism 23 to exert a force on a print-head towards the base when the tab is in the closed position and, also, an auxiliary push mechanism 24 that will be explained in more detail below.

Furthermore, the base 1 also provides for connections to other parts of the printer such as electric connections 10 and a pen pocket 11 with a fluid connection between the print head and the printer.

The base 1 is adapted to receive a print-head 3 in an insertion direction 30, for example, this insertion may be made in a direction perpendicular to the base 1 and that the print-head is straight so that all connections are properly assured and all datum surfaces are in contact with the counterparts in the print-head. Also, the ergonomics of the user have to be taken into account.

To achieve a proper insertion, the tab 2 needs to be as compact as possible and provide for an aperture angle that makes it easier for the user to insert the cartridge, that is, in an open position, the tab is to ensure that there is enough free space in the insertion direction so that the print-head can be inserted without obstacles that may affect the alignment in the insertion direction and, also, the user should be able to insert the cartridge without having to struggle with the different parts of the printer.

The carriage of FIG. 1 shows a carriage wherein the tab 2 comprises a latch 22 that can be biased to the locked position, i.e., the position wherein the lever is refracted towards the tab 2. The biasing allows for a greater aperture angle to be accomplished since, in the comparison shown in FIG. 1, a latch 22' with the lever separated from the tab, has a lower aperture angle, therefore a user may be blocked by other parts of the tab and preventing the print-head from joining the carriage through the insertion direction without obstacles. A more compact mechanism allows for better ergonomy and that more auxiliary devices can be attached to the tab.

For example, the tab may comprise an auxiliary push mechanism 24 to perform a further push on the print-head 3 when the tab 2 is in the closed position. This further push accomplishes that the print-head 3 is more rigidly fixed to the base 1 therefore achieving better mechanical, hydraulic and/or electric connections.

In another example, the auxiliary push mechanism 24 may be located between the rotatable connection 21 and the latch 22. In this case, the pushing force exerted by the auxiliary push mechanism 24 acts as a balancing force from the push mechanism 23 located in the latch 22, thereby achieving that a substantially uniform push force is exerted on the print-head 3 preventing the tilting of the print-head due, for example, to the pushing force exerted by the latch 22.

Figure 2:
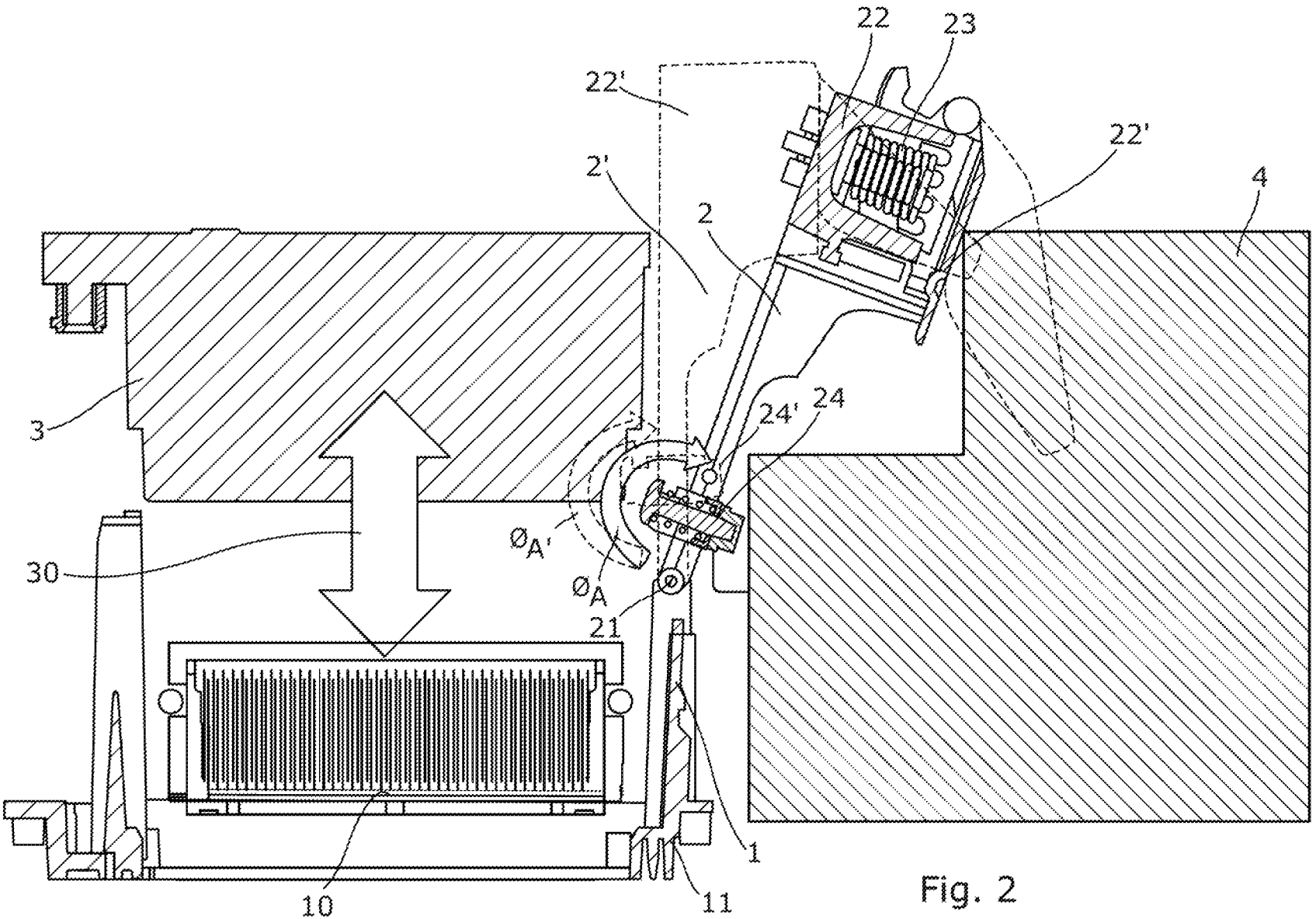
FIG. 2 shows the longitudinal section of FIG. 1 with two different types of latches.

FIG. 2 shows a transverse section to further stress the advantages of the print-head carriages disclosed herein. In FIG. 2 a comparison is shown between a second tab 2' that comprises a normally extended lever 223' in a second latch 22' and the tab with the normally retracted lever 223 located on the latch 22.

FIG. 2 shows that a lower aperture angle $\Phi_{A''}$ is achieved by the second tab 2' given that the normally extended lever 223' abuts a component 4 preventing the second tab 2' from moving further that the lower aperture angle $\Phi_{A''}$. As can be seen from this figure, using a normally extended lever 22' would not allow other projecting elements such as, e.g., an auxiliary push mechanism to be located in the tab since they would affect the ergonomy of the user for the insertion of the print-head or generate a condition wherein the print-head will enter the carriage tilted, causing erroneous electrical and/or hydraulic connections.

Figure 3:
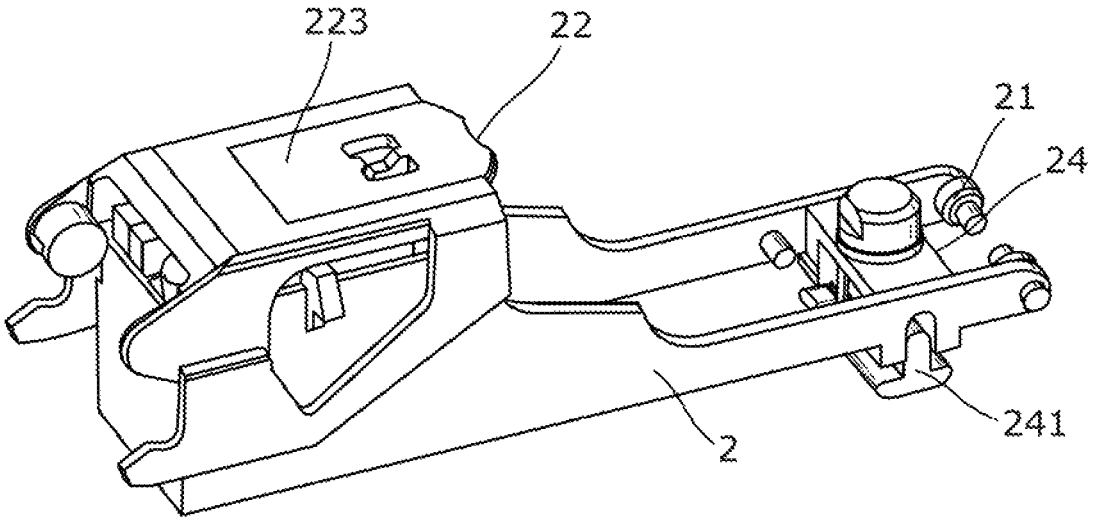
FIG. 3 shows a perspective view of an example of latch for a carriage of a wide format printer.

FIG. 3 shows in more detail the tab 2 including the latch mechanism 22. In particular, can be seen that this example of tab comprises an auxiliary push mechanism 24 that comprises a foot 241 wherein such foot has a transversely extending push surface so that it exerts a force over some of the print-head 3 transversal direction to perform a substantially uniform form at different transversal positions of the print-head 3 when the latch is in the closed position. The foot 241 may be of an elastic material such as rubber.

Figure 4:
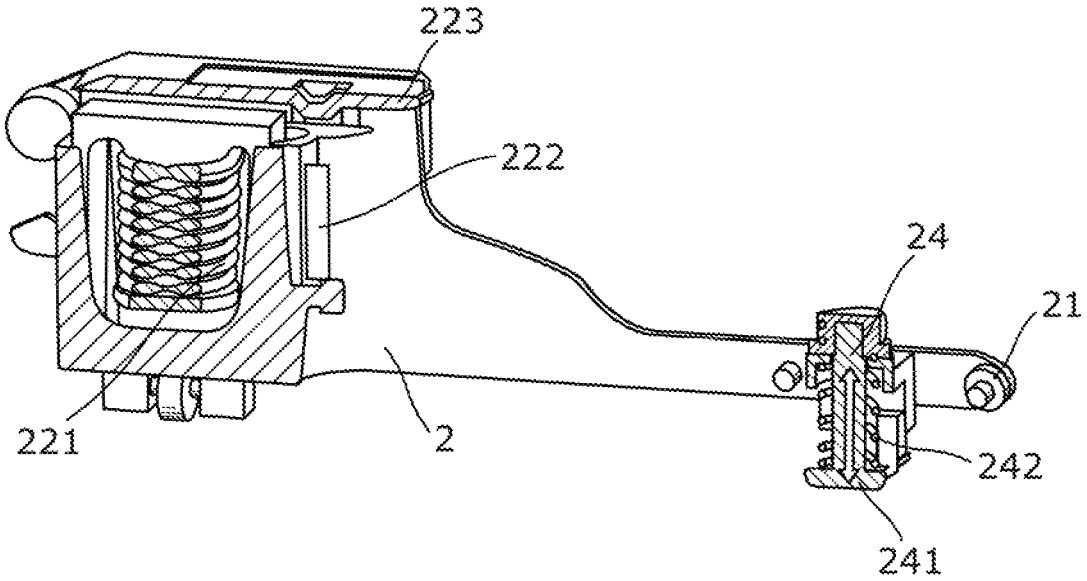
FIG. 4 shows a longitudinal section of the latch of FIG. 3.

On the other hand, it can be seen that the lever 223 is a normally closed lever, that is, a lever biased to the retracted position, FIG. 4 is a longitudinal section of the tab 2 of FIG. 3. In this figure it an be seen that the elastic foot 241 further comprises a foot spring 242 which provides the foot with the ability to perform the push force on the print-head 3.

Also, the latch 22 comprises two springs, extension spring 222 to bias the lever 223 to the retracted position and a push spring 221 at exerts a pushing force on the print-head 3 when the latch 22 is in the closed position.

In essence, it is disclosed a print-head carriage comprising base and a tab with a rotatable connection to the base on a first end, the rotation of the tab defining a closed position in which a second end opposite to the first end is in contact with the base and an open position in which the second end is separated from the base, the base being adapted to receive a print-head along an insertion direction when the tab is in the open position wherein the tab further comprises a latch located at a position remote to the rotatable connection comprising a lever, that separates from the tab in an unlocked position and moves towards the tab in a locked position; wherein the latch comprises a biasing mechanism to bias the latch to the locked position.

In an example, the latch comprises a push mechanism that exerts a force in the insertion direction at least when the tab is in the closed position, nonetheless, the push mechanism may adapted to exert a force on the print-head independently of the position of the latch. Furthermore, the tab may comprise an auxiliary push mechanism located between the first end and the latch wherein the auxiliary push mechanism may have a push mechanism that exerts a force in the insertion direction when the tab is in the closed position.

Also, the push mechanisms may comprise an elastic piece extending at least perpendicularly to the longitudinal axis of the tab. Examples of such elastic pieces may be: springs, elastic elements, a rubber, etc.

In an example, the base comprises a guide to position the print-head as it enters the base along the insertion direction. Also, the base may comprise a set of datum points positioned to connect to respective datum points on the print-head.

In a further example, the latch comprises a push mechanism that exerts a force in the insertion direction when the tab is in the closed position so that the exerted force connects the datum points on the base with the respective datum points on the print head. Furthermore, the tab may comprise an auxiliary push mechanism between the latch and the rotatable connection to exert a further force in the insertion direction when the tab is in the closed position. Both, the auxiliary and the push mechanism may comprise an elastic element to perform such push.

In the particular case, wherein the push mechanism is similar or, e.g., the same in the push mechanism and the auxiliary push mechanism the forces exerted by both mechanisms may be of substantially the same magnitude

What is claimed is:

1. A print-head carriage comprising a base and a tab with a rotatable connection to the base on a first end, the rotation of the tab defining a closed position in which a second end opposite to the first end is in contact with the base and an open position in which the second end is separated from the base, the base to receive a print-head along an insertion direction when the tab is in the open position wherein the tab further comprises:

a latch located at a position remote to the rotatable connection comprising a lever, that separates from the tab in an unlocked position and moves towards the tab in a locked position;

wherein the latch comprises a biasing mechanism to bias the latch to the locked position including when the tab is in the open position.

2. A print-head carriage according to claim 1 wherein the base comprises a guide to position the print-head as the print-head enters the base along the insertion direction.

3. A print head carriage according to claim 1 wherein the latch comprises a push mechanism that exerts a force in the insertion direction when the tab is in the closed position.

4. A print head carriage according to claim 3 wherein the push mechanism is to exert a force on the print-head independently of the position of the latch.

5. A print-head carriage according to claim 4 wherein the push mechanism comprises an elastic piece extending at least perpendicularly to the longitudinal axis of the tab.

6. A print-head carriage according to claim 5 wherein the elastic element is a spring.

7. A print-head carriage according to claim 1 wherein the tab comprises an auxiliary push mechanism located between the first end and the latch.

8. A print-head carriage according to claim 7 wherein the auxiliary push mechanism comprises another push mechanism that exerts a force on the print-head in the insertion direction when the tab is in the closed position.

9. A print head carriage according to claim 8 wherein the push mechanism is to exert a force on the print-head independently of the position of the latch.

10. A print-head carriage according to claim 1 wherein the biasing mechanism comprises an elastic element.

11. A print-head carriage according to claim 10 wherein the elastic element is a spring.

12. A print-head carriage according to claim 1 wherein the base comprises a set of datum points positioned to connect to respective datum points on the print-head.

13. A print-head carriage according to claim 12 wherein the latch comprises a push mechanism that exerts a force in the insertion direction when the tab is in the closed position so that the exerted force connects the datum points on the base with the respective datum points on the print-head.

14. A print-head carriage according to claim 13 wherein the tab comprises an auxiliary push mechanism between the latch and the rotatable connection to exert a further force in the insertion direction when the tab is in the closed position.

15. A print-head carriage according to claim 14 wherein the push mechanism and the auxiliary push mechanism exert forces with substantially the same magnitude.

16. A print-head carriage comprising:

a base, the base to receive a print-head along an insertion direction;

a tab with a rotatable connection to the base on a first end, the rotation of the tab defining an open position in which the tab is rotated away from the base to allow insertion of the print-head into the base and a closed position in which the tab is closed over a that portion of the base that receives the print-head;

a latch located on the tab at a position remote from the rotatable connection, the latch comprising a lever that rotates away from the tab to unlock the latch and moves towards the tab when in a locked position; and a biasing mechanism to bias the lever toward the locked position against the tab.

17. The print-head carriage of claim 16, further comprising an auxiliary push mechanism located on the tab between the first end and the latch, the auxiliary push mechanism exerting a pressure on the print-head toward the base when the tab is in the closed position.

18. The print-head carriage of claim 17, wherein the auxiliary push mechanism comprises an elastic foot.

19. The print-head carriage of claim 17, wherein the auxiliary push mechanism comprises a spring.

20. A print-head carriage comprising:

a base, the base comprising a recess to receive a print-head along an insertion direction;

a tab with a rotatable connection to the base on a first end, the rotation of the tab defining an open position in which the tab is rotated away from the base to allow insertion of the print-head into the base and a closed position in which the tab is closed over the recess of the base that receives the print-head;

a latch located on the tab at a position remote from the rotatable connection, the latch comprising a lever that rotates away from the tab to unlock the latch and moves towards the tab when in a locked position; and an auxiliary push mechanism located on the tab between the first end and the latch, the auxiliary push mechanism exerting a pressure on the print-head toward the base when the tab is in the closed position.

* * * * *